United States Patent [19]

Bogel

[11] Patent Number: 4,526,513

[45] Date of Patent: Jul. 2, 1985

[54] METHOD AND APPARATUS FOR CONTROL OF PIPELINE COMPRESSORS

[75] Inventor: Graham D. Bogel, Woodbury, Conn.

[73] Assignee: Acco Industries Inc., Trumbull, Conn.

[21] Appl. No.: 169,985

[22] Filed: Jul. 18, 1980

[51] Int. Cl.[3] ..... F04B 49/02; F04B 49/06; F04B 51/00

[52] U.S. Cl. ..... 417/5; 417/18; 417/20; 417/43

[58] Field of Search ..... 417/269, 18, 20, 43

[56] References Cited

U.S. PATENT DOCUMENTS

| | | | |
|---|---|---|---|
| 1,401,668 | 12/1921 | Brown | 415/26 |
| 2,478,423 | 8/1949 | Ponomareff | 415/27 |
| 3,119,552 | 1/1964 | Thomann | 415/26 |
| 3,732,034 | 5/1973 | Reid | 417/43 |
| 3,994,623 | 11/1976 | Rutshtein | 417/28 |
| 4,156,578 | 5/1979 | Agar | 417/27 |
| 4,177,649 | 12/1979 | Uenema | 417/43 |
| 4,204,808 | 5/1980 | Reese et al. | 417/2 |
| 4,225,289 | 9/1980 | Burkett | 417/20 |
| 4,236,379 | 2/1980 | Mueller | 417/32 |
| 4,248,194 | 2/1981 | Drutchus | 417/28 |
| 4,259,038 | 5/1981 | Jorgensen et al. | 417/5 |

FOREIGN PATENT DOCUMENTS

| | | | |
|---|---|---|---|
| 672708 | 10/1963 | Canada | 417/2 |
| 48101 | 4/1977 | Japan | 417/18 |
| 62701 | 5/1977 | Japan | 417/5 |
| 31201 | 3/1978 | Japan | 417/5 |
| 66002 | 6/1978 | Japan | 417/5 |
| 40308 | 3/1979 | Japan | 417/5 |
| 48003 | 3/1980 | Japan | 417/20 |
| 91784 | 7/1980 | Japan | 417/5 |
| 93987 | 7/1980 | Japan | 417/5 |
| 119986 | 9/1980 | Japan | 417/5 |
| 1021797 | 3/1964 | United Kingdom | 415/27 |

*Primary Examiner*—William L. Freeh

*Attorney, Agent, or Firm*—Pennie & Edmonds

[57] ABSTRACT

After the pumping station set points for a desired pipeline operation are calculated, they are used by process controllers at the individual pumping stations to control operations at the station. Measured values of the station's performance are compared with the set points. If these values differ enough as to require a change in the speed of the compressors, the speed of the compressors then operating is then slowly changed (or ramped) so as to bring the pipeline into operation at the set points that were calculated. Ramping is performed so that the operating efficiency of the compressors is always maintained at approximately a predetermined level. If it is found that a change is required in the number of compressors being used, this is brought to the attention of the operator of the pipeline who must then decide to let the controller effect the change. At frequent intervals, each compressor is checked for surge and stonewall conditions. In the event a surge condition is detected, the compressor's bypass valve is opened and the compressor is idled. After a suitable time delay, a test is made to determine if there is any speed at which the compressor can be operated for existing flow and compression ratios which will be on the compressor efficiency curve then being used. If so, the compressor is then loaded back on-line and ramped to the correct speed. If not, the operator is requested to permit operation of the compressor at a different efficiency level. If stonewall is present, it is necessary to put additional compressor units on line.

15 Claims, 17 Drawing Figures

METHOD AND APPARATUS FOR CONTROL OF PIPELINE COMPRESSORS

BACKGROUND ART

This relates to a method and apparatus for controlling a pipeline for the transmission of gas. More particularly, it relates to a method and apparatus for controlling the operation of compressors commonly used in pressure boosting stations along the pipeline.

Pressure boosting stations are used to maintain a desired discharge pressure, suction pressure and/or flow rate of the gas in the pipeline. Generally, pipeline boosting stations require compressors that have high capacities and low compression ratios (discharge pressure to suction pressure), typically, a ratio on the order of 1.3 to 1.

Centrifugal compressors are normally used to provide such high capacities and low compression ratios. Such compressors have lower maintenance costs, lower installation costs in the large capacity sizes, and greater reliability of service than reciprocating compressors. However, the centrifugal compressor is designed to operate at a particular point; and, as shown in FIG. 1, the efficiency of the compressor drops off rapidly if conditions deviate widely from the design point. FIG. 1 is a plot of the efficiency of a compressor versus inlet flow and head. The compressor operates most efficiently along the curve labeled optimum efficiency. The compressor may be operated at lesser levels of efficiency to the right or the left of the optimum efficiency line if it is not possible to achieve operation at optimum levels. Operation to the left of the optimum efficiency line emphasizes the production of more head than is optimally necessary, while operation to the right of the optimum efficiency line emphasizes the production of more flow than is optimally necessary. Thus, for a given compressor speed the compressor can be operated so as to produce any head and flow between the surge and stonewall lines at the efficiency level associated with the head and flow desired. In the prior art, when the operating speed of a compressor is changed from one level to another there is little or no control exercised over how that change is to be affected. As a result, in the prior art, there may be significant losses in operating efficiency when it becomes necessary to change the operating point of the compressor.

A further problem in the use of centifugal compressors is that their operating range is limited by "stall" and "surge" conditions. Stall occurs in a centrifugal compressor when the flow rate is increased to a point where the flow reaches a maximum rate for the given inlet conditions and speed of the compressor. For a given suction pressure and speed, discharge pressure decreases approximately linearly with the flow rate through the compressor. When the compressor stall point is reached, any further attempt to increase flow causes a rapid decrease in discharge pressure; thus, a limit is placed on the capacity of the compressor. Since the compressor is usually operated at varying speeds, stall conditions occur along a line known as the stall line (sometimes called "stonewall line") as shown in FIG. 1. When the compressor is operated at the stall line, no further increase in flow can be obtained for the particular set of conditions.

Surge occurs in a centrifugal compressor when the flow rate through the compressor is decreased to a point that is insufficient to maintain discharge pressure at a higher level than the line pressure into which the compressor is discharging. The discharge pressure falls below the line pressure momentarily, and a sudden reversal of flow occurs through the compressor. This sudden reversal of flow causes the compressor discharge pressure to rise and line pressures to drop until discharge pressure rises slightly above line pressure again. Since discharge pressure is now above line pressure, flow makes a second reversal and resumes its original direction. However, as soon as flow is resumed out of the compressor, discharge pressure begins to drop and line pressure rises until line pressure is again higher than the discharge pressure. The result is that the flow oscillates and shocks are transmitted to the compressor which vary from an audible rattle to a violent shock that can damage the compressor impeller, and even possibly bend the compressor shaft.

The points at which surge occurs are shown plotted as the surge line in FIG. 1. The compressor should not be operated at or to the left of the surge line, and since the compressor cannot be operated to the right of the stall line, the operating range of the centrifugal compressor is between the surge and the stall lines. For a given discharge pressure, the centrifugal compressor can be seen to have a narrow operating range. For this reason, the centrifugal compressor can only be used where conditions do not vary widely. Because the flow rate through the pipeline does tend to vary widely, it is common practice to locate several compressors at each boosting station and to vary the number of compressors in use so as to maintain the desired operating parameters.

The equation for the surge line is:

$$P_D - P_S = K_1(Q_A)^2 \frac{P_S}{T_S} \tag{1}$$

where $P_D$=Discharge Pressure $P_S$=Suction Pressure $K_1$=Constant $T_S$=Suction Temperature $Q_A$=Volumetric flow measured at inlet conditions The relation between the actual inlet flow, $Q_A$, and the inlet flow at base conditions, $Q_I$, is given by $$\frac{Q_I \cdot P_B}{T_B} = \frac{Q_A \cdot P_S}{T_S} \tag{2}$$

where $P_B$=Base Pressure $T_B$=Base Temperature

The inlet flow at base conditions can also be shown to be $$Q_I = \frac{h \cdot P_S}{T_S} \tag{3}$$

where h=differential pressure across an inlet orifice plate

Substituting, equation (3) into equation (2) and rearranging $$Q_A = \sqrt{\frac{h \cdot T_S}{P_S}} \cdot \frac{P_B}{T_B} = K_2 \sqrt{\frac{h \cdot T_s}{P_S}} \quad (4)$$

where $K_2$ is a constant.

Substituting equation (4) in equation (1)

$$P_D - P_S = K_1 \cdot K_2^2 \cdot \frac{h \cdot T_S}{P_S} \cdot \frac{P_S}{T_S} \quad (5)$$

$$= K_3 \cdot h$$

where $K_3$ is a constant.

Hence, at any point along the surge line, the pressure difference across a centrifugal compressor is proportional to the pressure differential across the inlet orifice plate; and by measuring the pressure difference across a centrifugal compressor, a minimum inlet orifice differential can be calculated which will prevent the compressor from going into surge. In the prior art, inlet flow and hence the pressure differential across an inlet orifice is maintained at a minimum level by apparatus which senses the compression ratio of the compressor and, when it approaches surge conditions, bypasses some of the discharge gas through a pneumatically operated bypass valve back into the suction side of the compressor. This maintains a minimum throughput through the compressor even when the minimum system throughput is less than the level which would put the compressor into surge if there were no feedback of gas through the bypass valve.

This technique, however, is wasteful of energy and the energy is lost in raising the temperature of the gas. If the temperature gets too high, it is necessary to shut down the compressor which is likely to affect the operation of the other compressors at the same boosting station and perhaps the operation of the entire pipeline. Moreover, this prior art technique provides no means of eliminating the surge condition once it has begun. As a result, compressors that fall into surge condition can remain operating with their bypass valves open for long periods of time (days or weeks)if they do not overheat. Moreover, once the surge condition is noticed by the pipeline operator, it is usually necessary to shut the compressor down and modify the pipeline operating parameters before the compressor can be used again. As will be apparent, coping with surge conditions with such prior art techniques can seriously affect the supply of gas and/or the operating efficiency of the pipeline.

DISCLOSURE OF INVENTION

I have found that the operating efficiency of a pipeline may be improved and its compressors protected from surge conditions by controlling the pipeline operating parameters so that the compressors are operated near their most efficient point and away from any surge condition. To achieve this, the operating parameters (or set points) of the pipeline are determined by use of a mathematical model of the pipeline at each pumping station taking into account its supply capacity, line inventory, required loads, fuel requirements and horsepower requirements. The set points calculated are suction pressure, discharge pressure, flow, discharge temperature limit and turbine exhaust temperature limit.

Pipeline models are well known and widely used throughout the gas transmission industry. Basically, these models break the pipeline into segments which are connected in series with each other. For each segment, the suction (or inlet) pressure to the segment, the discharge (or outlet) pressure from the segment and the flow through the segment are related by a mathematical formula known as the Panhandle (or Weymuth) Formula. If two of these three values are known, the third can be determined from the Formula. Also used in calculating the unknown parameter are the length of the segment, its diameter, the efficiency factor of the segment, the mean flowing temperature, the gas temperature at the inlet and the outlet of the segment, the compressibility factor of the gas, and the specific gravity of the gas. For modeling purposes, the discharge (or outlet) pressure and the flow from one segment is assumed to be the suction (or inlet) pressure and the flow into the next segment.

After the pumping station set points for a desired pipeline operation are calculated, they are used by process controllers at the individual pumping stations to control operations at the station. Measured values of the station's performance are compared with the set points. If these values differ enough as to require a change in the speed of the compressors, the speed of the compressors then operating is then slowly changed (or ramped) so as to bring the pipeline into operation at the set points that were calculated. Ramping is performed so that the operating efficiency of the compressors is always maintained at approximately a predetermined level. If it is found that a change is required in the number of compressors being used, this is brought to the attention of the operator of the pipeline who must then decide to let the controller effect the change. This permits the operator to exercise his judgment, taking into account conditions that are not entered into the process controller. If the operator permits the change to be made, the controller then implements it. For example, if a compressor is to be added, the controller first starts up the compressor, then idles the other operating compressors and finally brings (or loads) the additional compressor on-line. Once the extra compressor is loaded on-line, the speed of all the compressors is then ramped at a substantially constant predetermined operating efficiency to match the flow rate at the pumping station and then is adjusted further toward the desired flow setpoint.

At frequent intervals during operation, each compressor is checked for surge and stonewall conditions. In the event a surge condition is detected, the compressor's bypass valve is opened and the compressor is idled. After a suitable time delay, a test is made to determine if there is any speed at which the compressor can be operated for existing flow and compression ratios which will be on the compressor efficiency curve then being used. If so, the compressor is then loaded back on-line and ramped to the correct speed. If not, the operator is requested to permit operation of the compressor at a different efficiency level.

The compressor is also tested for stonewall condition. If stonewall is present, it is necessary to put additional compressor units on line.

BRIEF DESCRIPTION OF THE DRAWINGS

These and other objects, features, elements and advantages of the invention will be apparent from the following detailed description of the best mode for carrying out the invention wherein.

BEST MODE FOR CARRYING OUT THE INVENTION

Figure 2:
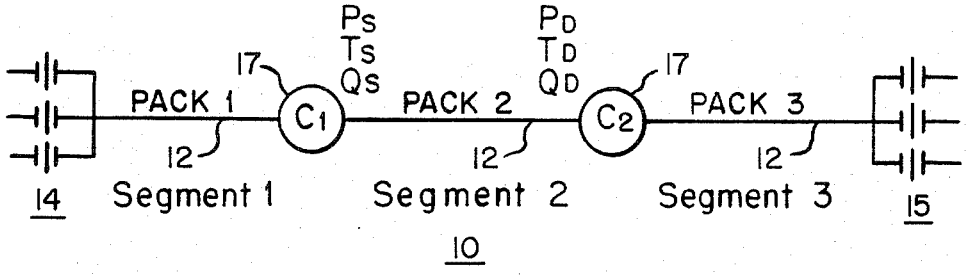
FIG. 2 (Prior Art)
FIG. 2 is a schematic illustration of a pipeline.

As shown in FIG. 2, the typical pipeline system 10 comprises a pipeline 12, a source 14 and a load 15. Along the pipeline are one or more pumping stations 17 for maintaining the desired flow of gas in the pipeline. For modeling purposes the pipeline may be divided into segments, each segment having a suction (or inlet) pressure, $P_S$, a gas temperature at the inlet, $T_S$, a suction flow, $Q_S$, a discharge (or outlet) pressure, $P_D$, a gas temperature at the outlet, $T_D$, and a discharge flow, $Q_D$. For modeling purposes the discharge pressure and flow from one segment is assumed to be the suction pressure and flow into the next segment. Preferably, each pumping station, the pipeline between the source and the first pumping station, the pipeline between adjacent pumping stations, and the pipeline between the last pumping station and the load are treated as separate segments.

Figure 3:
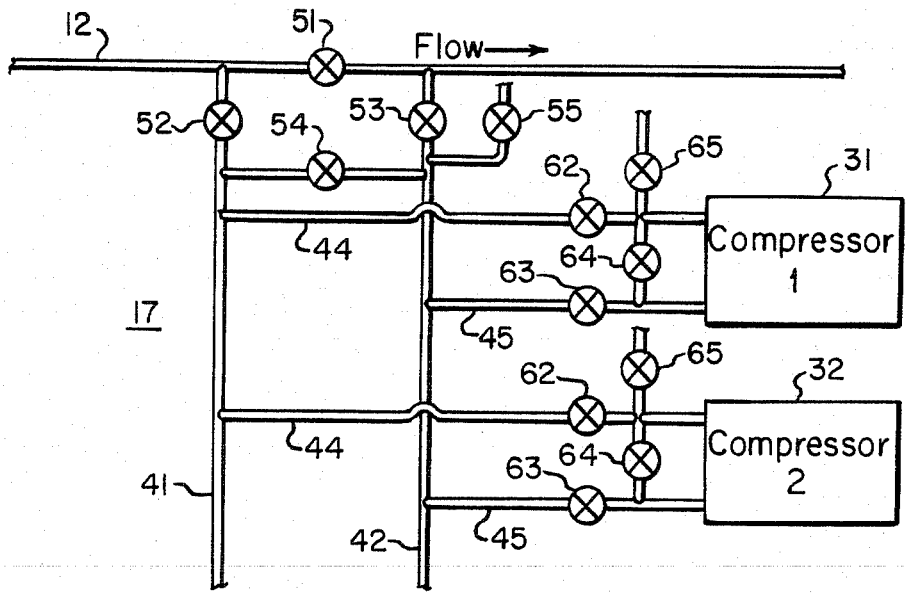
FIG. 3 (Prior Art)
FIG. 3 is a schematic illustration of a pumping station for a pipeline.

A schematic illustration of a typical pumping station 17 is set forth in FIG. 3. As shown therein, the station includes a plurality of compressors, of which compressors 31 and 32 are shown, a multiplicity of valves and appropriate piping. Connected to pipeline 12 is a station suction header 41 and a station discharge header 42. For each compressor in the station, a compressor suction header 44 is connected to the station suction header 41 and a compressor discharge header 45 is connected to the station discharge header 42. In the pipeline 12 is a block valve 51. A station suction valve 52 and a station discharge valve 53 regulate the flow of gas between pipeline 12 and the station suction header and station discharge header, respectively. Between the station suction header and the station discharge header is a bypass valve 54. A station blowdown valve 55 is also connected to the station discharge header. In analogous fashion, a compressor suction valve 62 and a compressor discharge valve 63 connect each compressor to the station suction header and the station discharge header, respectively. On the compressor side of these valves, a compressor bypass valve 64 connects the compressor suction header and the compressor discharge header; and a compressor blowdown valve 65 is connected to the compressor suction header.

The number of pumping stations that are used depends on the desired flow and pressure in the system. When not in use the pumping station is simply bypassed. When the station is on-line, block valve 51 is closed; the suction and discharge valves 52, 53 are open; and the bypass and blowdown valves 54, 55 are closed. When the station is bypassed, station block valve 51 is open; the station suction and discharge valves 52, 53 are closed; and the station bypass valve 54 and blowdown valve 55 are open. In like fashion, for each compressor, its valves are operated either to bypass the compressor or to put it on-line.

When a station is to be put on-line at least one compressor is started and is permitted to warmup. Upon completion of warmup, a sequence of operation for putting the station and/or compressor on-line is illustratively as follows:

Before starting:

1. Open station suction valve 52 slowly.
2. Close station blowdown valve 55 after purging.
3. Open compressor suction valve 62.
4. Close compressor blowdown valve 65 after purging.

After warmup:

5. Open station discharge valve 53.
6. Close station block valve 51.
7. Open compressor discharge valve 63.
8. Close compressor by-pass valve 64.
9. Close station by-pass valve 54.

Once the station is on-line, additional compressors are added or removed from operation as necessary, to maintain the desired operating parameters.

At each station, upstream of the station suction header, measurements are made of the suction pressure, $P_S$, the temperature of the gas, $T_S$, and, if advisable, the density of the gas. The discharge pressure, $P_D$, is also measured downstream of the station discharge header. Such measurements are conventional and suitable devices for making such measurements are well known in the art.

Figure 4:
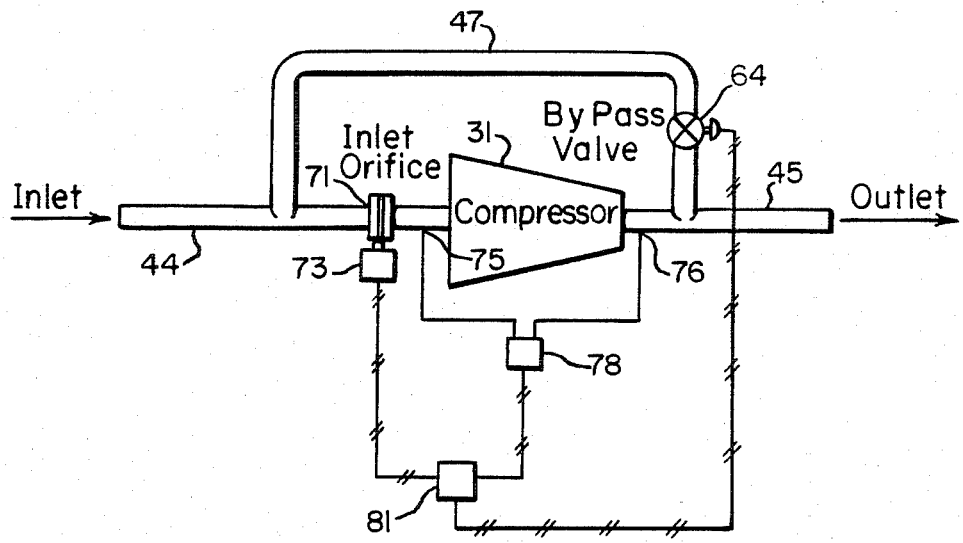
FIG. 4 (Prior Art)
FIG. 4 is a schematic illustration of an illustrative prior art arrangement for controlling surge in a compressor.

In the prior art it is customary to protect a compressor from surge condition by means of the bypass valve. As shown in FIG. 4, a conventional control system comprises compressor 31, compressor suction header 44, compressor discharge header 45, a bypass header 47 and bypass valve 64. The system also includes an inlet orifice 71, a differential pressure transmitter 73 connected to measure the differential pressure across the inlet orifice, pressure sensors 75, 76 at the inlet and outlet of the compressor, and a pressure difference transmitter 78 connected to pressure sensors 75, 76. As is well known, the gas flow at the inlet can be determined from the differential pressure across the inlet orifice. Pressure sensors 75, 76 permit the measurement of the compression ratio or head. Electric signals from transmitters 73, 78 are conducted over appropriate leads to a proportional controller 81 where they are compared with appropriate set points determined by a surge line such as that of FIG. 1. If the compressor flow falls too low, bypass valve 64 is opened so as to increase the flow through compressor 31.

While such a feedback system protects the compressor from surge condition, it is not very effective in operation of the bypass valve and it provides no means for correcting the pipeline conditions which caused the surge in the first place. If the compressors are connected in parallel, as shown in FIG. 3, one unit may be in surge while the other units maintain the conditions that caused surge. Moreover, when starting compressors in parallel installations, compressors may be put into surge by the head generated by units already online. If the compressors are connected in series, it is likely the efforts of one unit to compensate for surge will throw all other units into surge. As a result, once the bypass valve in a surge control system is opened, it frequently stays open for a long period of time causing losses in the operating efficiency of the pipeline. Moreover, since the energy lost increases the temperature of the pipeline gas, it frequently happens that the compressor overheats and is forced to shut down altogether.

To improve the operating efficiency of pipeline systems and to reduce the problems caused by surge, I have designed a pipeline control system in which the operating parameters of the system at each pumping station are constantly measured and compared with their set points so that the pumping station is always aware of any deviation from the optimum operating point for the station. Each time the operating parameters are measured, an evaluation is made of the need for a change in the speed and number of compressors being used to pump the gas through the station at a predetermined efficiency level. If it is determined that a change in speed is needed, the speed of the compressors is ramped to the new level along substantially the efficiency curve at which the compressors are then operating. If it is determined that more compressors are needed, these are brought on line and are ramped to the desired operating speed. Alternatively, if fewer compressors are needed the surplus compressors are shut down. As a result each station is always aware of changes in its operating conditions and is able to adjust to them rapidly.

At frequent intervals in the operation of each station, each compressor is checked for operation within the limits of the surge and stonewall lines. In the event a surge condition is sensed, the compressor is bypassed and placed in the idle mode and, after a suitable delay, a determination is made whether it can be operated at the desired efficiency level somewhere within its normal range of operating speeds. If it can, the compressor is brought back on line and ramped to operate at such speed. Otherwise, a decision is made to change the efficiency level of the station. In the event a stonewall condition is sensed, a recalculation is made of the need for additional compressors. In all cases, ramping of compressor speed is performed so that the speed follows the efficiency curve at which the compressor is then operating.

Figure 5:
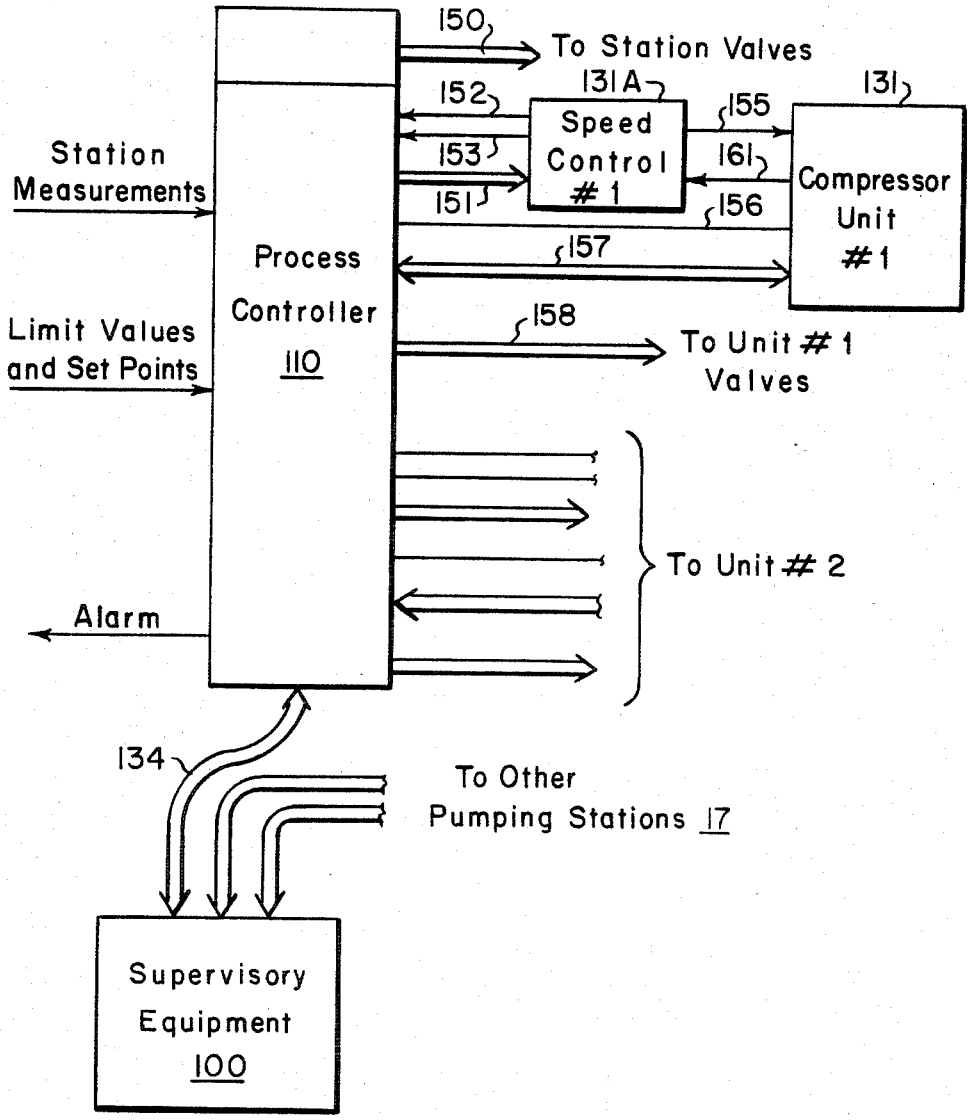
FIG. 5 is a schematic illustration of an illustrative embodiment of a process controller and compressor speed control useful in practicing the invention.

In accordance with the invention, the foregoing operations are preferably conducted by one or more process controllers which control the operation of a plurality of compressors at a pipeline pumping station. As shown in FIG. 5, an illustrative embodiment of a suitable pipeline control system comprises supervisory equipment 100 and, at each pumping station, at least one process controller 110 and several compressor units, of which only one is shown in detail. Each compressor unit includes a compressor speed control 131A, and a compressor 131 as shown in FIG. 5 as well as the conventional headers and valves needed to connect the compressor to the station (see FIG. 3), the inlet orifice, pressure differential transmitter, pressure sensors and pressure difference transmitter (see FIG. 4), and the temperature and density sensors and the like used to measure inlet flow and the relevant pressures, temperatures and densities at the inlet and outlet of the compressor. Similar pressure, temperature and density sensors (not shown) are also located at the inlet of the pumping station; and a pressure sensor is at the outlet of the station.

Figure 6:
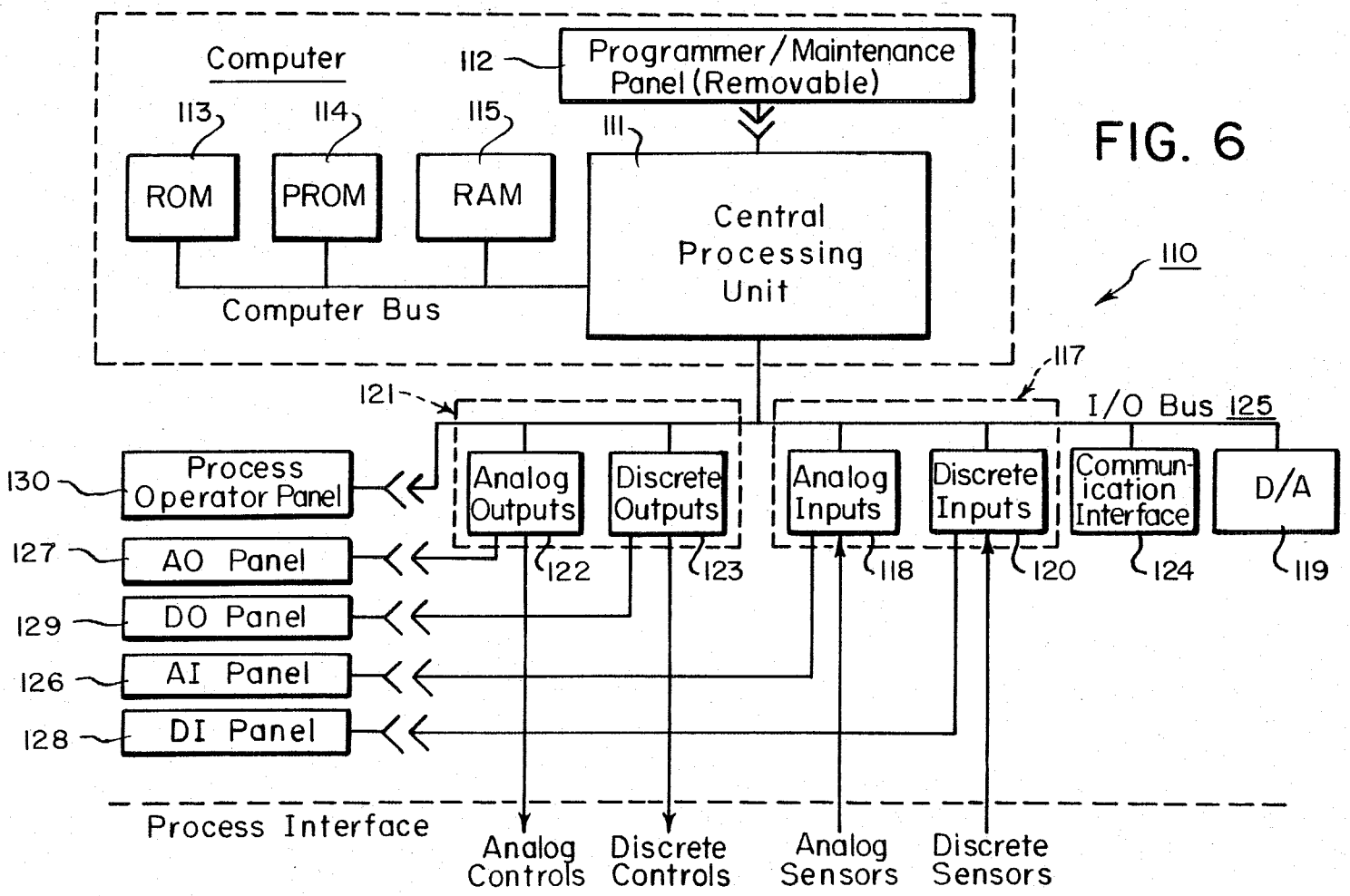
FIG. 6 is a schematic illustration of a detail of FIG. 5.

Process controller 110 preferably is an electronic digital process controller such as that described in detail in U.S. Pat. No. 4,064,394, which is incorporated herein by reference. A block diagram for this controller is shown in FIG. 6. As shown therein, controller 110 comprises a central processing unit 111 which includes a programmer/maintenance panel 112, a read only memory 113, a programmable read only memory 114, and a random access memory 115. It also includes input means 117, output means 121 and a process operator's panel 130.

Input means 117 comprises one or more analog input modules 118 and one or more discrete input modules 120. Modules 118 are provided with a plurality of terminals (not shown) for (1) receiving analog electrical input signals from analog process sensing devices, (2) operating in conjunction with a converter 119 to convert the analog input signals into digital form, and (3) transmitting the signals to the computer over a plurality of respective paths. A preferred module can accept eight or more analog signals having a voltage range from 0–10 volts (or alternatively 1–5 volts) and a current range from 4–20 milliamps. Modules 120 are provided with a plurality of terminals (not shown) for (1) receiving discrete electrical input signals from discrete process sensing devices, (2) converting the discrete input signals to appropriate levels of current and voltage, and (3) transmitting the signals to the computer over a plurality of respective paths. A preferred module can accept sixteen or more such signals in the form of voltages of up to 110 volts AC or DC.

Output means 121 generates output control signals in response to commands from processor 110 and transmits these control signals through appropriate output paths to a plurality of process control devices. Output means 121 comprise one or more analog output modules 122 and one or more discrete output modules 123. Analog output modules 122 (1) receive digital commands from the computer, (2) convert the commands to electrical analog control signals, and (3) transmit these analog signals through respective paths to a plurality of analog process control devices. A preferred module can transmit signals having a voltage range from 0–10 volts (or 1–5 volts) at a current range from 4–20 milliamps to four or more analog control devices. Discrete output modules 123 (1) receive discrete signals from the computer, (2) convert these signals to discrete control signals having appropriate levels of current and voltage, and (3) transmit these discrete control signals through respective paths to a plurality of discrete process control devices. A preferred module can switch currents of up to 300 milliamps at voltages of up to 50 volts for transmission to 16 or more discrete control devices. The input and output modules, the converter and a communication interface 124 are all coupled to the central processing unit through an input/output bus 125.

Panels 126 through 129 are coupled to the input and output modules in order that the process control engineer may have access to the signals being received and control over those being sent out. The analog input panel 126 is provided with a plurality of meters for simulataneously displaying the value of the analog signals received at several selected analog inputs.

Analog output panel 127 is similarly provided with a plurality of meters for simultaneously displaying the value of the analog signals present at several selected analog outputs. It is also provided with switching means for manually overriding computer control of the analog output.

Discrete input panel 128 is provided with indicators, such as light emitting diodes, for simultaneously displaying the state of several different discrete inputs.

Discrete output panel 129 is likewise provided with indicators for simultaneously displaying the state of several discrete outputs. It is also provided with switching means for manually overriding computer control of the discrete process control devices.

Process operator's panel 130, provides the primary interface between the process control engineer and the electronic process controller. In substance, the process operator's panel provides means, in the form of selectable keys, whereby the process control engineer can select one or more analog or discrete input signals to be processed by the computer, one or more digitally simulated analog or discrete control blocks to process selected input signals, and one or more output paths through which process signals derived from processing the input signals can be transmitted to one or more selected process control devices. In addition, the panel provides means for specifying the position of each one of a plurality of selected simulated control blocks in a simulated control circuit.

As will be apparent from the description set forth in U.S. Pat. No. 4,064,394, the process controller has substantial arithmetic and logic capability and is able to perform calculations on the signals it receives from both its analog and discrete inputs and to produce both discrete and analog outputs in response to such calculation. In addition to the signals received from various sensing devices, the process controller is also able to accept manual inputs from a human operator via the keyboard of the process operator panel and inputs from remote stations via communication interface 124. Extensive details on the operation of the process controller are set forth in the '394 patent and will not be repeated here.

In the present invention, as shown in FIG. 5, the process controller at each pumping station receives station measurements and compressor measurements as well as information on limit values and set points. The station measurements in the form of analog or digital signals are derived from appropriate sensors connected to the pipeline. These measurements include the following parameters:

$P_S$=Suction pressure at station inlet.

$P_D$=Discharge pressure at station outlet.

$T_S$=Temperature of gas at suction side.

$\gamma$=Density of gas on suction side.

$Q_A$=Volumetric flow measured at inlet conditions.

For each compressor that is operating the appropriate sensors measure the following parameters:

$P_S$=Suction pressure $P_D$=Discharge pressure h=Differential pressure across inlet orifice $T_S$=Temperature of gas at suction side $T_D$=Temperature of gas at discharge side N=Speed of compressor in RPM $\gamma$=Density of gas on suction side R=Compression ratio $Q_A$=Volumetric flow measured at inlet conditions These measurements are made continously by appropriate state of the art devices. The signals available from these devices are read by the process controller approximately every second.

The process controller compares these station and compressor measurements with limit values and operating set points that are entered into the process controller either manually or automatically from supervisory equipment 100. For example, as shown in FIG. 5, the process controller at each pumping station is linked to supervisory equipment by communication lines 134.

The limit values define the maximum and minimum operating points for the parameters of interest at each pumping station and each compressor in the pipeline system. As will be apparent, these are unique to the system and once they are entered into the individual process controller there is no need to change them. The set points specify the desired operating parameters of the pipeline for the real-time flow rate and pressure. Advantageously, these values are calculated by a suitable processor using a mathematical model for the entire pipeline system. The particular set points that apply to the operation of a given pumping station are then entered into the process controller for that pumping station. Advantageously, the pipeline model is resident in the supervisory equipment 100 and the set points are communicated to the process controllers of the different pumping stations by communication lines 134. For each pumping station, the set points supplied to the station include the desired values of the suction pressure, $P_S$, from pipeline 12, the discharge pressure, $P_D$, to pipeline 12, the volumetric flow at base conditions, $Q_I$, the temperature, $T_D$, of the gas at discharge to pipeline 12 and the turbine exhaust temperature, $T_T$, for the prime mover that powers the pumping station.

Alternatively, the controller at each station can model its own segment of the pipeline using the mathematical model and data from the closest upstream pumping station indicating the pressure and temperature of the gas at the point of its discharge from said station. Obviously, in such a configuration, the same discharge information is transmitted by a given process controller to the closest downstream pumping station.

The operation of each compressor unit is controlled by a speed control unit, such as unit 131A, which may be part of the process controller or may be an individual component. Illustratively, the speed control unit is a conventional analog controller which uses a proportionalintegral-derivative feedback loop to control the speed of the compressor unit. Such a controller operates the compressor with a signal that is the sum of (1) a signal proportional to the difference (or error) between the desired speed of the compressor and its actual speed, (2) a signal proportional to the integral of such error and (3) a signal proportional to the derivative of this error. In known fashion, the speed control unit can be overridden to correct for deviations between the desired and measured values of suction pressure, discharge pressure, flow and temperature. Illustratively, the speed control unit can comprise an override station and an override selector, Model Nos. 2753-81A and 2781-40A manufactured by the Bristol Division of ACCO Industries Inc. of Waterbury, Connecticut.

Accordingly, the process controller supplies each speed control unit 131A with signals on lines 151 representing the suction pressure, $P_D$, the discharge pressure, $P_S$, the volumetric flow, Q, the discharge temperature, $T_D$, and the minimum and maximum speed limitations for the compressor. In known fashion, the speed of the compressor is measured by a tachometer and supplied to the control unit on line 161. The process controller receives back from each speed control system signals on lines 152 and 153, indicating whether the speed control unit is operating in an automatic override mode or a manual mode.

From the values supplied by the process controller, the speed control unit calculates an error signal that is supplied to the compressor on line 155 to cause the compressor to operate at the desired speed. Other signals are applied directly from the process controller to the compressor and from the compressor to the process controller via lines 157. These signals include a stop command and a run command applied from the controller as well as signals indicating ESD status, load status, running status and bypass open status from the compressor. The stop and run commands are used to stop and start the compressor. The status signals indicate whether an emergency shutdown (ESD) is underway, whether the compressor is pumping gas with the bypass closed (loaded), whether the compressor is running, and whether the bypass valve is open.

Figure 7A:
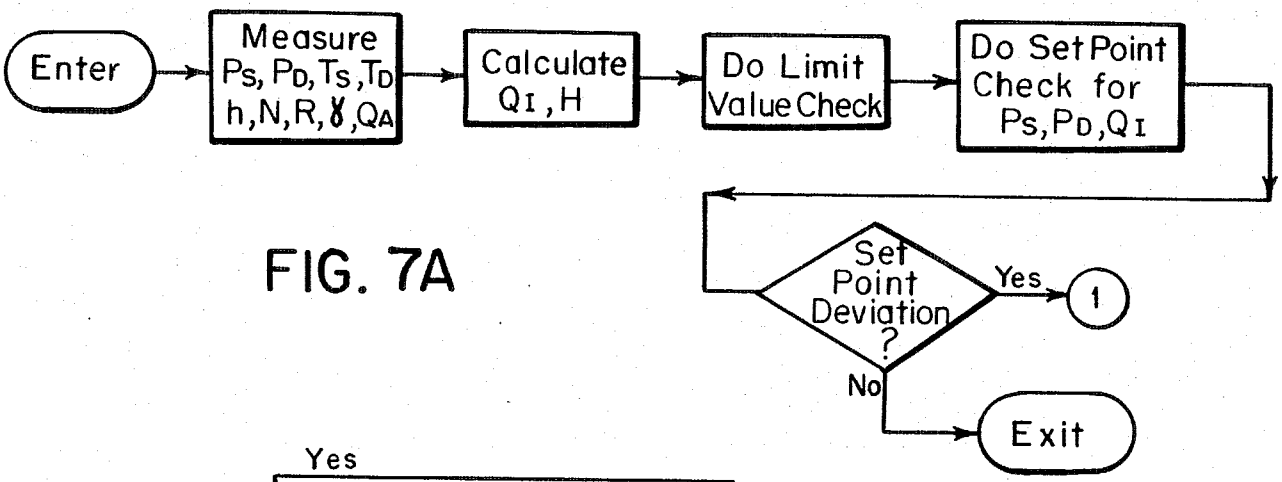
FIGS. 7A through 7H are schematic illustrations of flowcharts of process control programs which may be used with the process controller of FIG. 5 and the pumping station of FIG. 3 to change the number of compressors in use at a pumping station.

The operation of this system will be more readily apparent from the flow charts depicted in FIGS. 7A through 7H, 8 and 9. As shown in FIG. 7A, the process controller at a station continually measures the station and/or compressor operating parameters, $P_S$, $P_D$, $T_S$, $T_D$, h, N, R, $\gamma$, and $Q_A$ as discussed in conjunction with FIG. 5. Using well-known equations it calculates from a set of these values the volumetric inlet flow at base conditions, $Q_I$, as well as the isentropic head H. Next, it compares the measured station and compressor operating parameters with the limit values specified for the station and the compressors. Then it does a set point check comparing the measured values $P_S$ and $P_D$, and the calculated value $Q_I$ with their set points to determine if the system is indeed operating at the flow rate and head intended. As will be apparent from FIG. 1, for this flow rate and head, there is also a corresponding efficiency level. If there is no deviation, the process controller simply recycles to another measurement of the operating parameters. If there is a deviation, it goes on to the procedure charted in FIG. 7B.

Figure 7B:
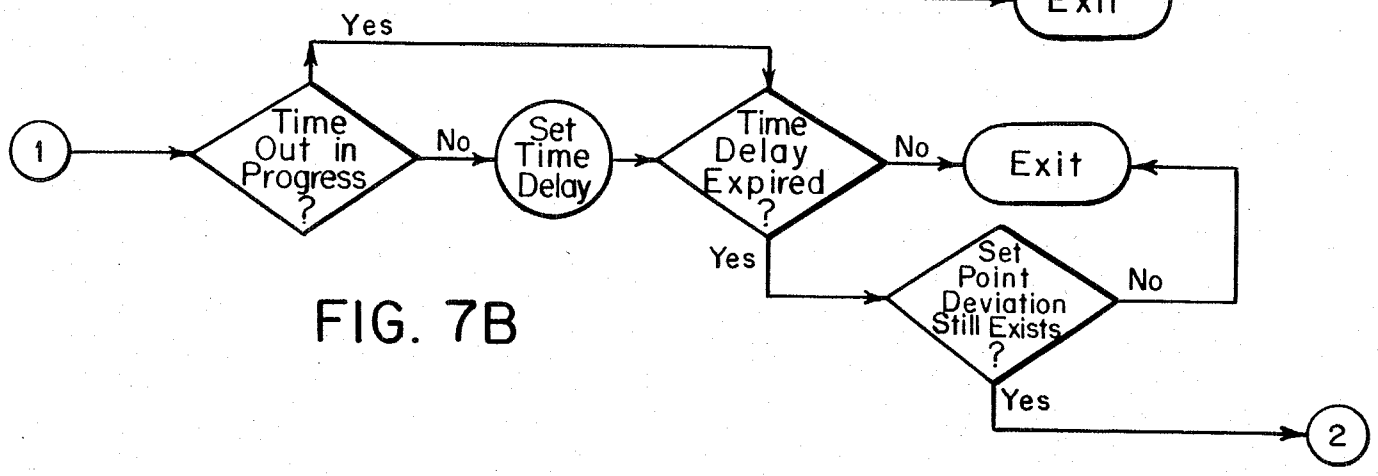
Figure 7C:
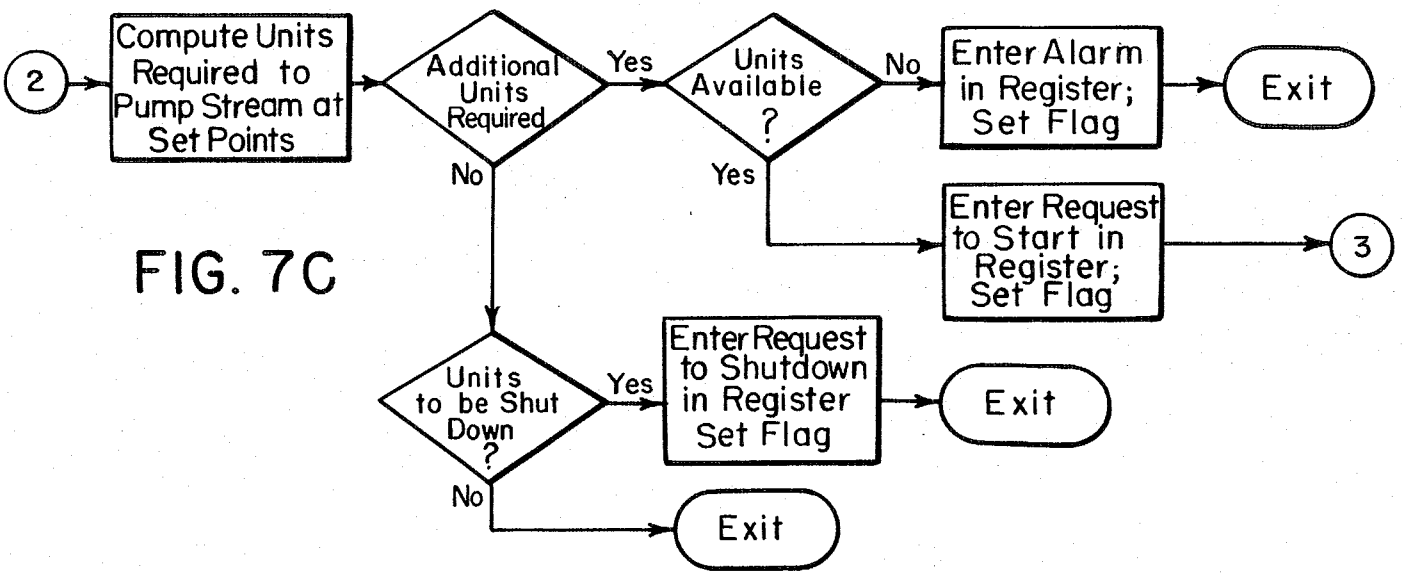

FIG. 7B is merely a time delay, typically of about thirty seconds, which is used to minimize the effect of transients. Until the delay expires, the process controller simply recycles through the procedure of FIG. 7A or performs other tasks in operating the pumping station. If a set point deviation still exists after the delay expires, the procedure moves on to that shown in FIG. 7C.

If there is a set point deviation, the process controller then calculates the number of compressors required to pump the gas stream at the specified set points. This calculation is a standard calculation well known in the operation of a gas pipeline. If it is determined that no additional units are required and none are to be shut down, the controller simply returns to measuring the operating parameters in accordance with FIG. 7A. If it is determined that units are to be shut down, the controller performs a shut down sequence as detailed below and then returns to measuring the operating parameters. If it is determined that additional compressor units are required, the sequence first determines if any units are available. If there are none, an alarm is noted, a flag is set and the process controller returns to making measurements of the operating parameters. If, however, a unit is available, the controller enters a request to start it in an appropriate register and sets an appropriate flag.

The request to start is a request to the human operator of the pipeline system to approve the decision to place an additional compressor on line. Advantageously this request is displayed on one of the Analog or Discrete Output Panels 127, 129. Alternatively, this request could be made to a supervisory control program but with present operating procedures it is preferred to make the request to a human operator. This permits the operator to take into account other factors which might be difficult to implement in an operating program. For example, the operator might be aware of imminent changes in pipeline flow which would make it inefficient to start up an additional compressor.

Figure 7D:
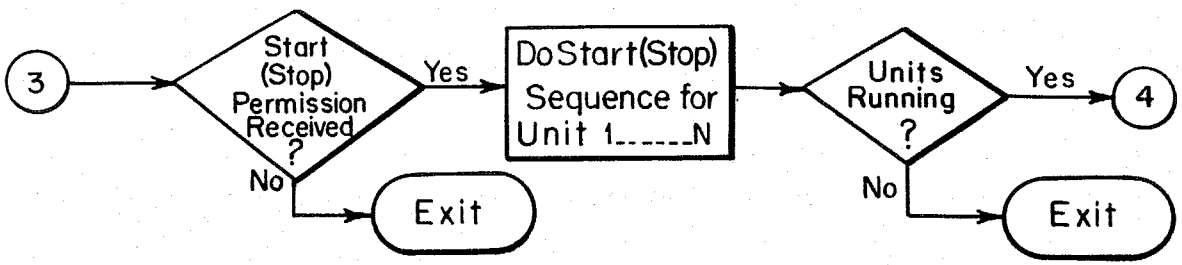
Figure 7E:
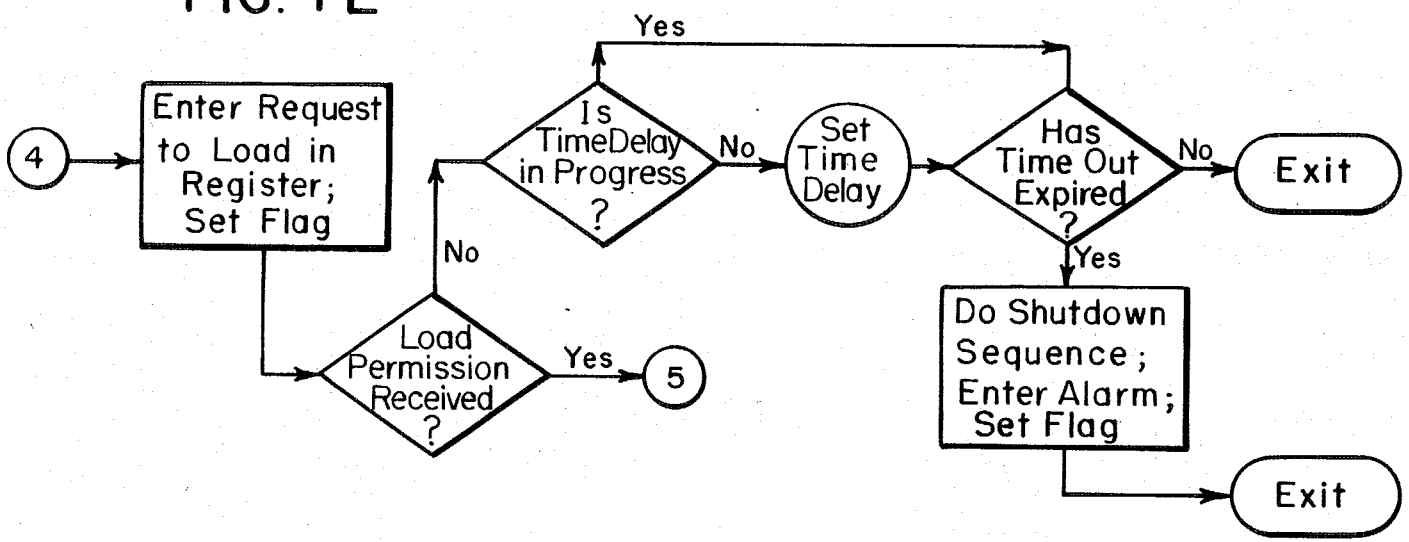
Figure 7F:
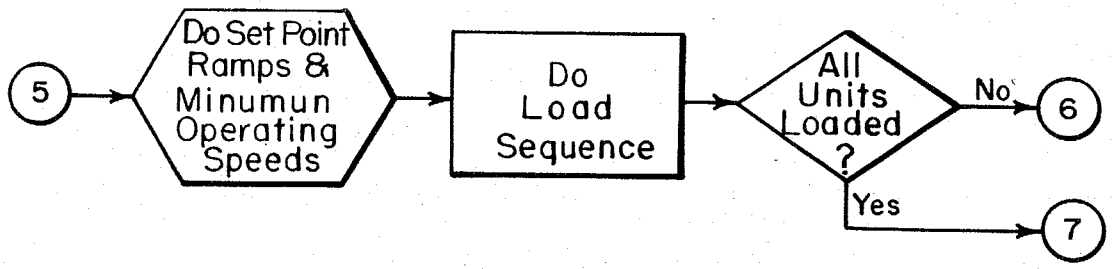

If the operator agrees that another compressor should be added, he enters his assent through the keyboard of process operator panel 130. As shown in FIG. 7D, the process controller tests for receipt of this start permission. If it is not received, the controller returns to FIG. 7A. If it is received, it implements a start signal for however many compressors it has determined are necessary and available. The start sequence is also a standard procedure which basically involves turning on the compressor drive motor and bringing the compressor up to idle speed, a speed at which the compressor does not pump gas. While the start sequence is being implemented, the process controller is constantly testing to determine if the units are running. Once all the additional units desired are running, the procedure advances to that shown in FIG. 7E.

The process controller then makes a request to load and sets a flag. Upon receipt of the load permission from the operator, the controller moves on to the process of FIG. 7F. If a load permission is not received, a time delay of a minute or so commences. Until the time delay expires, the process controller continues to request permission to load. If the delay expires without receipt of this permission, the process controller executes a shut down sequence for the units it just started up, enters an alarm, sets a flag and returns to measuring the operating parameters as in FIG. 7A. The shut down sequence is a standard procedure for stopping the compressor. If a load permission is received, the process controller fully opens the by-pass valves of all other compressors then in operation at the station and reduces their speed to idle. The process controller then ramps the operating speed of all the compressors to be used up to the point where they will pump gas. Next, it loads all these compressors on-line by closing their bypass valves and then it tests to see if it has loaded all the units that are to be loaded. If not, the procedure continues with that shown in FIG. 7G.

Figure 7G:
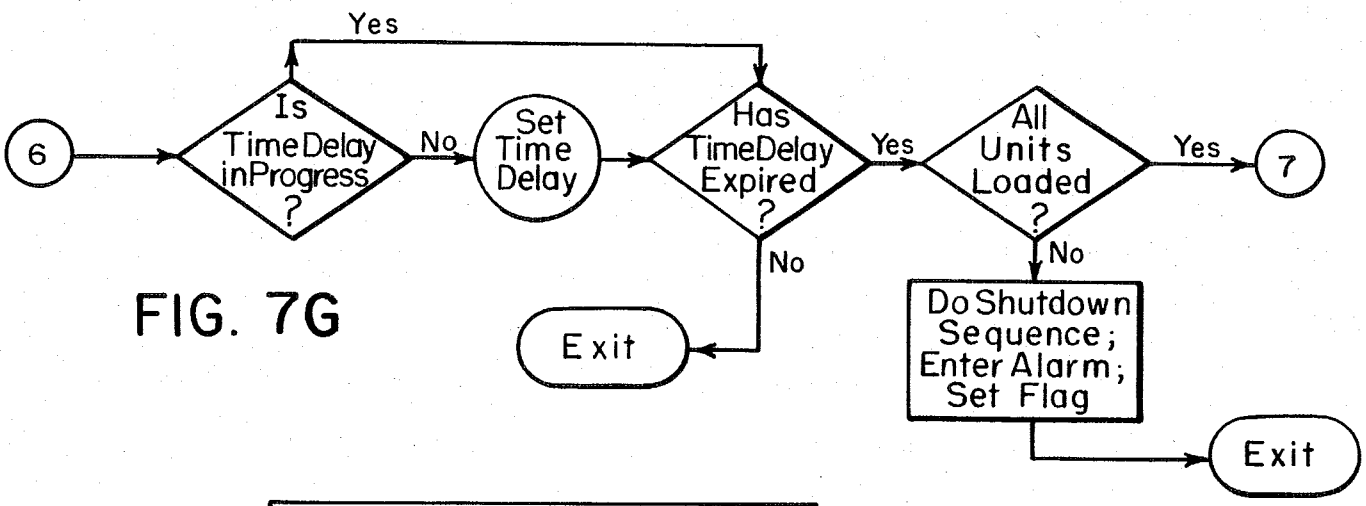
Figure 7H:
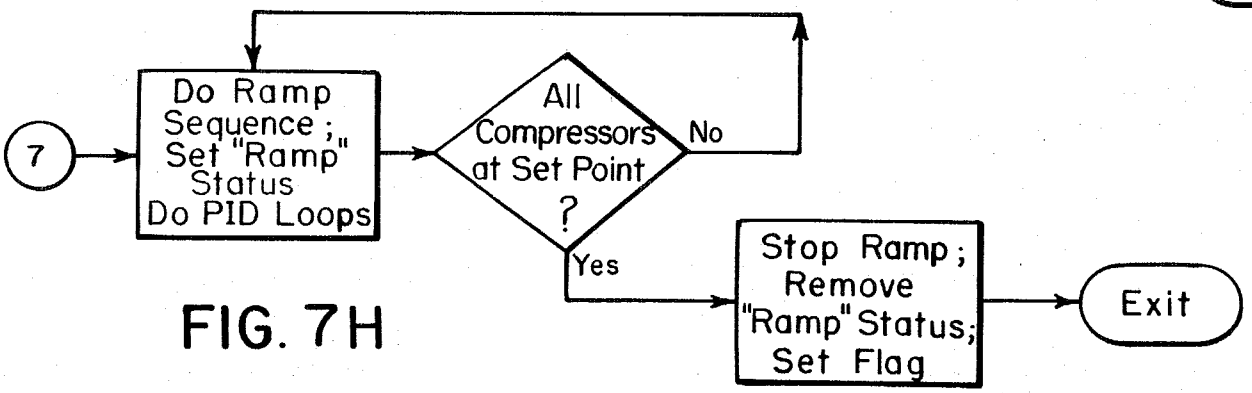

All the compressor units should be loaded on-line within a few seconds of each other. To control this, a time delay is used as shown in FIG. 7G. If the time delay has not expired, the process controller returns to FIG. 7F to continue the load sequence. Once the time delay has expired, the process controller tests to see if all units are loaded. If they are not, it shuts down all the units, enters an alarm, sets a flag and returns to the process of FIG. 7A to measure operating parameters. If all units are loaded, it goes on to the procedure charted in FIG. 7H.

Once the units are loaded, their speed is ramped substantially along the desired operating efficiency curve to match the flow rate at the station and further changes are then made in the speed along the same efficiency curve toward the desired flow set point. The ramp sequence is described in detail in FIG. 8. While this sequence is being performed, a flag is set indicating a ramp status. In accordance with standard industry practice, proportional, integral and derivative feedback control (PID loops) are used in the ramp sequence to ramp the speed of the compressor to the desired set point. While the ramp sequence is continuing, the process controller frequently tests to determine if the compressors are at their set points. Once they are, the ramp sequence removes the ramp status flag and returns to measuring the operating parameters of the system in accordance with FIG. 7A.

Figure 1:
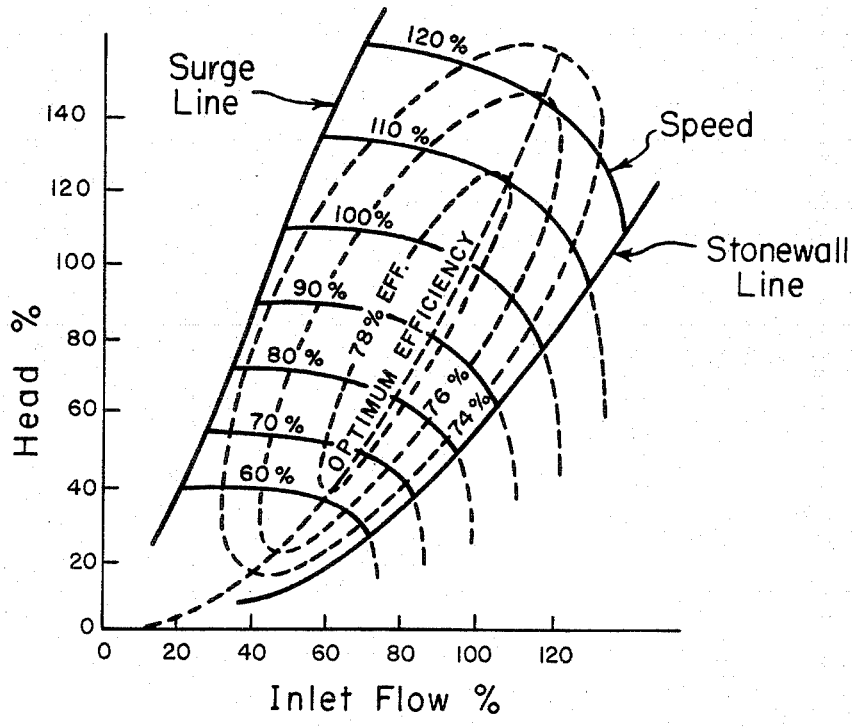
FIG. 1 is a plot of an illustrative centifugal compressor performance curve.

To understand the ramp sequence, it is helpful to refer to FIG. 1 which relates compressor speed and efficiency to head and flow. The compressor operates most efficiently along the curve labeled "optimum efficiency". Other operating curves of lesser efficiency may be established on either side of the optimum efficiency curve. In accordance with the invention, a function table is stored in the process controller for seven curves setting forth the speed of the compressor that is needed to achieve the desired efficiency for different values of head and flow. When the operating speed of one or more compressors is to be changed from one value to another on the same efficiency curve, the speed is then ramped so that the values of head and flow remain approximately in the relation specified by the efficiency curve joining the initial speed and the final speed. As a result, the compressor, or compressors, is always operated at substantially the same efficiency. In contrast, in the prior art, speed changes in compressor operation have typically been conducted with no concern for their effect on efficiency; and, as a result, severe losses in efficiency frequently occur in the process of moving from an initial speed to a final speed.

Figure 8A:
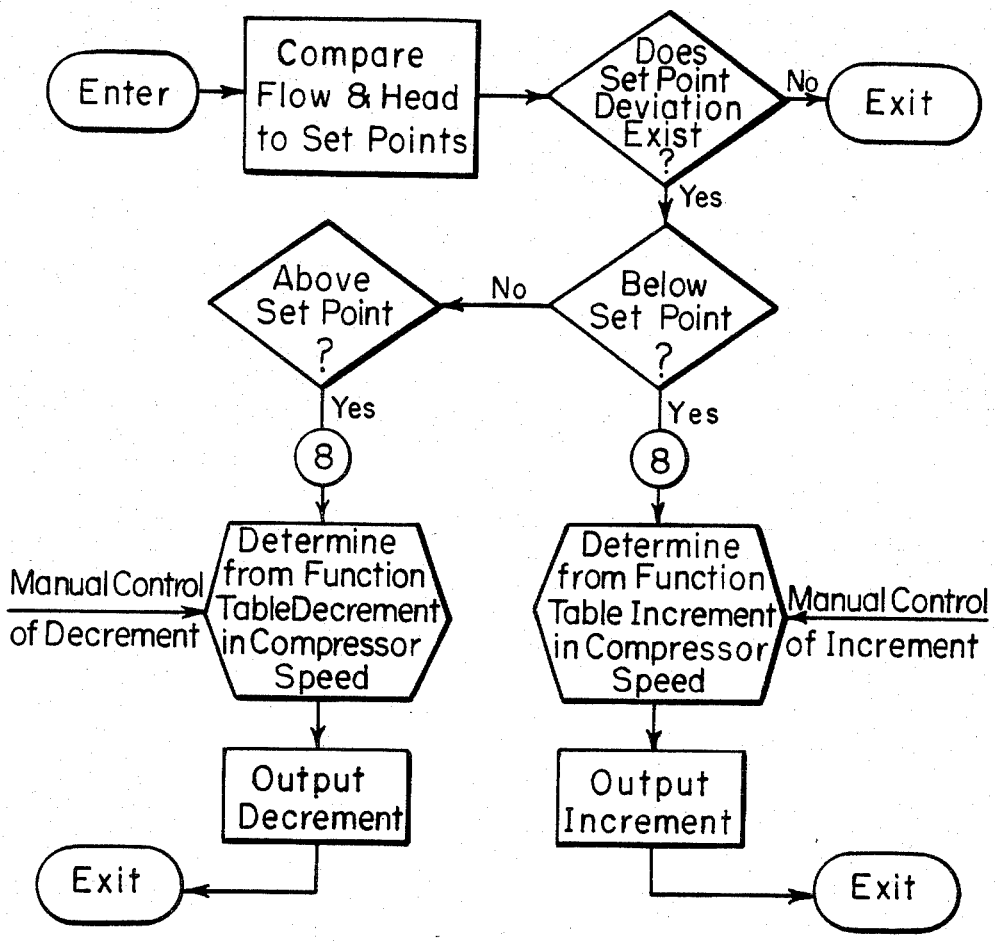
FIG. 8 is a schematic illustration of a flowchart of a process control program which may be used with the process controller of FIG. 5 and the pumping station of FIG. 3 to adjust compressor speed.
Figure 8B:
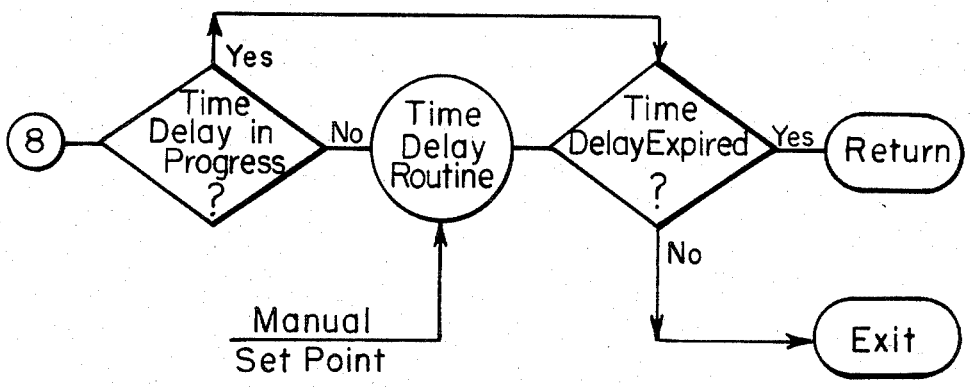
Figure 9:
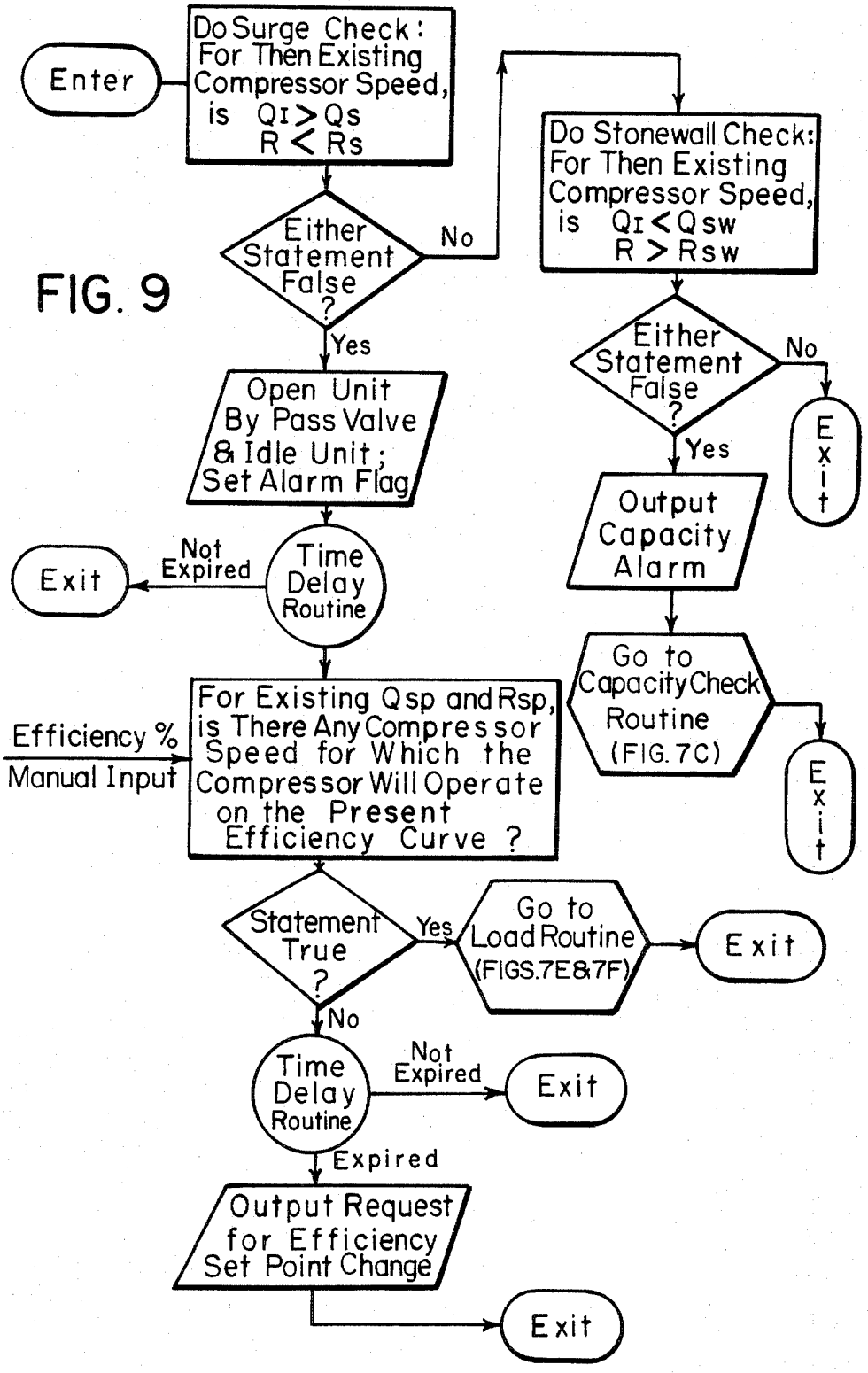
FIG. 9 is a schematic illustration of a flowchart of a process control program which may be used with the process controller of FIG. 5 and the pumping station of FIG. 3 to maximize the efficiency of operation of the pipeline and protect the pumping station compressors from surge.

As shown in FIG. 8, upon entering the ramp sequence, the process controller compares station flow and head with the set points. If a set point deviation exists, it determines if the compressor, or compressors, is then operating above or below the set point. In either case, as shown at 8, a brief time delay is used to eliminate the effect of transients. If the operating point is above the set point, the process controller determines from the function table stored in its memory a decrement in the speed of the compressor such that the compressor will still operate along approximately the same efficiency curve. The speed of the compressor is then reduced to this point by applying the appropriate signal to the speed control unit. Analogously, if the operating point is below the set point, the process controller determines from the function table an increment in compressor speed along the same efficiency curve and increases the compressor speed accordingly.

The determination of a decrement or an increment is a straight forward matter. For each efficiency curve, the process controller stores a set of pairs of values of head and flow and for each pair a corresponding speed. The size of the increment (or decrement) can be the next higher (or lower) pair of values stored in memory, the second higher (or lower) pair, or some other multiple. Alternatively, by use of an interpolation formula, non-integral speed increments (or decrements) can be calculated. As will be apparent, the smaller any increment the closer the speed of the compressor will follow the desired efficiency curve but the longer the ramping process will take. Advantageously the amount of the increment (or decrement) can be controlled manually by the operator of the pipeline system to change the speed of response of the system.

The shutdown sequence used to remove a compressor from on-line begins by fully opening the bypass valves of all compressors then operating and idling the compressors. As shown in FIG. 5, the bypass valves are controlled from the process controller via one of lines 158 and the compressors are switched from run to idle by a change in the signal on line 156. Then the compressors to be removed from operation are brought to a stop while the others are loaded back on-line in accordance with the load sequence described above.

At regular intervals, such as once every few seconds the process controller at each pumping station that is in operation also performs a check for surge, stonewall and operating efficiency of each compressor then running.

The check begins with a check for surge. Specifically, for the then existing compressor speed, the process controller tests whether the inlet flow at base condition, $Q_I$, is greater than the inlet flow, $Q_S$, at which surge will commence and whether the head, R, is less than the head, $R_S$, at which surge will commence. If either statement is false, then one or more of the compressors then operating is in surge or is in danger of surge and it is necessary to remove it from this state. This is done by immediately opening the bypass valve and reducing the speed of all the compressors then operating to the idle speed just as in the shutdown sequence. At the same time, an alarm flag is set in the process controller and a status signal indicating that the bypass valves are open is applied to the process controller from the compressor via one of lines 156.

The procedure then enters a time delay similar to those described above which is ordinarily long enough to permit the next downstream pumping station to draft the pipeline enough to eliminate the surge condition. Until the time delay expires, the process controller is available to perform other tasks in operating the pumping station. Once the time delay expires, the controller tests to determine if there is any compressor speed for which one or more of the compressors will operate on the present efficiency curve at the existing set points for flow and head. If there is, then the controller loads the compressor (or compressors) on-line and brings it up to speed in accordance with the load and ramp routines of FIGS. 7E and 7F. Once these routines are complete, the controller returns to measuring the station operating parameters.

If the compressor will not operate on the present efficiency curve, the controller enters a time delay similar to those described above. During this delay the controller is available to perform other tasks at the pumping station. If the condition still exists at the end of the time delay, the controller produces a request for a change in the efficiency set point and then returns to its usual operation. If the operator choses to implement a change in the efficiency set point, this can be done manually or by telemetry input from the supervisory equipment 100. Once such a change is implemented, further executions of the program of FIG. 9 will take this change into account.

On the other hand, if the compressor passes the surge check, it is next checked for stonewall at the then existing compressor speed. To avoid stonewall condition, the inlet flow at base conditions, $Q_I$, must be less than the inlet flow at stonewall, $Q_{SW}$, and the head, R, must be greater than that at stonewall, $R_{SW}$. If these conditions are met, the controller terminates execution of this procedure. If, however, the compressor is at the stonewall line, an alarm is issued and the controller executes the capacity check routine detailed in FIG. 7C. If this routine indicates that additional compressors are needed, such compressors are brought on line in accordance with the procedure of FIG. 7D through 7G. Once this is done, the controller returns to normal operation of the pumping station.

As will be apparent, numerous modifications may be made to the above described method and apparatus within the spirit and scope of the invention. The invention may be practiced using compressors connected in parallel as shown in FIG. 3 or in series. As will be apparent, some station measurements may be the same as individual compressor measurements for some compressor configurations that may be used. In such cases it obviously will not be necessary to use redundant measuring equipment or to perform redundant measurements. It should also be noted that the techniques of this invention may also be practiced with axial compressors in place of centrifugal compressors.

What is claimed is:

1. In a pipeline for the transmission of gas, said pipeline having at least one pumping station where at least one centrifugal or axial compressor is used to pump gas through said pipeline, a method of changing the speed of said compressor from an initial value to a final value, said method comprising the steps of:

a. measuring operating parameters of said pumping station and said compressor;

b. calculating from the measured operating parameters the volumetric inlet flow at base conditions;

c. comparing the volumetric inlet flow at base conditions and the head with set point values for said volumetric inlet flow and head;

d. if a set point deviation exists, determining an incremental change in the speed of said compressor such that the operating efficiency of said compressor at said incremented speed approximately conforms to a predetermined operating curve extending between said initial value and said final value along which the operating efficiency of said compressor is approximately constant, e. incrementing the speed of said compressor in accordance with the increment determined by step (d), and f. repeating steps (a) through (e) until the speed of said compressor reaches the desired final value, whereby the operating speed of the compressor is caused to change along a predetermined efficiency curve.

2. The method of claim 1 further comprising the steps of:

testing said compressor to determine if it is operating near the surge line, idling said compressor if it is operating near the surge line until the pipeline conditions which caused it to operate near the surge line are removed, and returning said compressor to operation once said conditions are removed.

3. The method of claim 1 further comprising the steps of:

testing said compressor to determine if it is operating near the surge line, idling said compressor if it is operating near the surge line until the pipeline conditions which caused it to operate near the surge line are removed, and returning said compressor to operation once said conditions are removed.

4. The method of any one of claims 2 or 3 wherein the step of returning said compressor to operating comprises the steps of:

testing to determine if the compressor can be operated at any speed at the efficiency level desired at the then prevailing head and flow in the pipeline, causing said compressor to operate at said speed if such efficiency level can be achieved, and changing the efficiency level of operation of the compressor if the former efficiency level can not be achieved.

5. In a pipeline for the transmission of gas, said pipeline having at least one pumping station where at least one centrifugal or axial compressor is used to pump gas through said pipeline, a method of changing the speed of said compressor from an initial value to a final value, said method comprising the steps of:

a. storing a table of values which relate different levels of the volumetric inlet flow at base conditions and head of the gas to the speed of said compressor, said table of values defining at least one operating curve of constant efficiency, b. measuring operating parameters of said pumping station and said compressor;

c. calculating from the measured operating parameters the volumetric inlet flow at base conditions;

d. comparing the volumetric inlet flow at base conditions and the head with set point values for said volumetric inlet flow and head;

e. if a set point deviation exists, determining at least one incremental change in the speed of said compressor such that the operating efficiency of said compressor at said incremented speed approximately conforms to said efficiency curve, f. incrementing the speed of said compressor in accordance with the increment determined by step (e), and g. repeating steps (b) through (f) until the speed of said compressor reaches the desired final speed, whereby the operating speed of the compressor is caused to change along said efficiency curve.

6. In a pipeline for the transmission of gas, said pipeline having at least one pumping station where at least one centrifugal or axial compressor is used to pump gas through said pipeline, a method of protecting said compressor from operation near the surge line comprising the steps of:

measuring operating parameters of said compressor including inlet flow and head, comparing values that are functions of the measured inlet flow and head with set point values to determine if said compressor is operating near the surge line, idling said compressor if it is operating near the surge line, measuring operating parameters of said compressor until the pipeline conditions which caused said compressor to operate near the surge line are removed, and returning said compressor to operation once said conditions are removed wherein said returning step comprises the steps of:

testing to determine if the compressor can be operated at any speed at the efficiency level desired at the then prevailing head and flow in the pipeline, causing said compressor to operate at said speed if such efficiency level can be achieved, and changing the efficiency level of operation of the compressor if the former efficiency level can not be achieved.

7. In a pipeline for the transmission of gas, said pipeline having at least one pumping station where at least one centrifugal or axial compressor is used to pump gas through said pipeline, apparatus for changing the speed of said compressor from an initial value comprising:

means for relating a plurality of values of volumetric inlet flow at base conditions and head of the gas to the speed of said compressor, said values defining at least one operating curve of constant efficiency, means for measuring the operating parameters of said pumping station and said compressor;

means for calculating from the measured operating parameters the volumetric inlet flow at base conditions;

means for comparing the volumetric inlet flow at base conditions and the head with set point values for said volumetric inlet flow and head;

means, operable when a set point deviation exists, for determining from said relating means a new speed of said compressor, said speed being such that said compressor operates on approximately the same efficiency curve at said speed, as it does at said initial speed, and means for causing said compressor to operate at said new speed.

8. The apparatus of claim 7 further comprising means for repeating the determination of a new speed and the change to said speed for at least one more speed of said compressor between the present speed of the compressor and said final value, said speed being such that said compressor operates on approximately the same efficiency curve at said new speed as it does at said present speed.

9. The apparatus of claim 7 further comprising:

means for testing said compressor to determine if it is operating near the surge line, means for idling said compressor if it is operating near the surge line until the pipeline conditions which caused it to operate near the surge line are removed, and means for returning said compressor to operation once said conditions are removed.

10. The apparatus of claim 9 wherein the means for returning said compressor to operation comprises:

means for testing to determine if the compressor can be operated at any speed at the efficiency level desired at the then prevailing head and flow in the pipeline, means for causing said compressor to operate at said speed if such efficiency level can be achieved, and means for changing the efficiency level of operation of the compressor if the former efficiency level can not be achieved.

11. In a pipeline for the transmission of gas, said pipeline having at least one pumping station where a plurality of centrifugal or axial compressors may be selectively used to pump gas through said pipeline, a method of operating said compressors comprising the steps of:

calculating for said pipeline set point values of at least the suction pressure from the pipeline upstream of said station, the discharge pressure to the pipeline downstream of said station and the flow through said pipeline at base conditions, measuring at said station at least the suction pressure from the pipeline, the discharge pressure to the pipeline and the flow, calculating from the values measured at said station the volumetric flow at base conditions, comparing the measured values of suction pressure and discharge pressure and the calculated value of volumetric flow at base conditions with the calculated set point values, determining on the basis of said comparison if a change should be made in operating speed of the compressors being used to pump gas at said station, and if the operating speed of the compressors is to be changed, making said change in small increments such that the efficiency of the compressors whose speed is being changed substantially conforms to a predetermined curve of constant efficiency throughout said speed change.

12. The method of claim 11 further comprising the steps of:

determining if a change should be made in the number of compressors being used to pump gas at said station, and if the number of compressors is to be changed, making said change by opening the bypass valves of all compressors then operating and idling said compressors, changing the number of compressors operating to the number that is desired, closing the bypass valves for said compressors and increasing their speed to the desired operating speed by making said change in small increments such that the efficiency of the compressors whose speed is being changed substantially conforms to a predetermined curve of constant efficiently throughout said speed change.

13. In a pipeline for the transmission of gas, said pipeline having at least one pumping station where at least one centrifugal or axial compressor is used to pump gas through said pipeline, apparatus for protecting said compressor from operation near the surge line comprising:

means for measuring operating parameters of said compressor including inlet flow and head, means for comparing values that are functions of the measured inlet flow and head with set point values to determine if said compressor is operating near the surge line, means for idling said compressor if it is operating near the surge line until the pipeline conditions which caused it to operate near surge line are removed, and means for returning said compressor to operation once said conditions are removed, said returning means comprising:

means for testing to determine if the compressor can be operated at any speed at the efficiency level desired at the then prevailing head and flow in the pipeline, means for causing said compressor to operate at said speed if such efficiency level can be achieved, and means for changing the efficiency level of operation of the compressor if the former efficiency level can not be achieved.

14. In a pipeline for the transmission of gas, said pipeline having at least one pumping station where at least one centrifugal or axial compressor is used to pump gas through said pipeline, a method of protecting said compressor from operation near the surge line comprising the steps of:

measuring operating parameters of said compressor including inlet flow and head, comparing values that are functions of the measured inlet flow and head with set point values to determine if said compressor is operating near the surge line, idling said compressor if it is operating near the surge line until the pipeline conditions which caused it to operate near the surge line are removed, and returning said compressor to operation once said conditions are removed, wherein said step of returning said compressor to operation comprises the steps of:

testing to determine if the compressor can be operated at any speed at the efficiency level desired at the then prevailing head and flow in the pipeline, causing said compressor to operate at said speed if such efficiency level can be achieved, and changing the efficiency level of operation of the compressor if the former efficiency level cannot be achieved.

15. In a pipeline for the transmission of gas, said pipeline having at least one pumping station where at least one centrifugal or axial compressor is used to pump gas through said pipeline, apparatus for protecting said compressor from operation near the surge line comprising:

means for measuring operating parameters of said compressor including inlet flow and head, means for comparing values that are functions of the measured inlet flow and head with set point values to determine if said compressor is operating near the surge line, means for idling said compressor if it is operating near the surge line until the pipeline conditions which caused it to operate near the surge line are removed, and means for returning said compressor to operation once said conditions are removed, wherein said means for returning said compressor to operation comprises:

means for testing to determine if the compressor can be operated at any speed at the efficiency level desired at the then prevailing head and flow in the pipeline, means for causing said compressor to operate at said speed if such efficiency level can be achieved, and means for changing the efficiency level of operation of the compressor if the former efficiency level cannot be achieved.

* * * * *